US009427064B2

(12) United States Patent
Kim

(10) Patent No.: US 9,427,064 B2
(45) Date of Patent: Aug. 30, 2016

(54) LIQUID DROPPER ALLOWING QUANTITATIVE WITHDRAWAL, AND A COSMETIC CONTAINER EQUIPPED WITH THE SAME

(75) Inventor: Yu-Seob Kim, Incheon (KR)

(73) Assignee: YONWOO CO., LTD, Incheon (KR)

( * ) Notice: Subject to any disclaimer, the term of this patent is extended or adjusted under 35 U.S.C. 154(b) by 822 days.

(21) Appl. No.: 13/503,029

(22) PCT Filed: Dec. 17, 2009

(86) PCT No.: PCT/KR2009/007576

§ 371 (c)(1),
(2), (4) Date: Jun. 26, 2012

(87) PCT Pub. No.: WO2011/049267

PCT Pub. Date: Apr. 28, 2011

(65) Prior Publication Data

US 2012/0261029 A1 Oct. 18, 2012

(30) Foreign Application Priority Data

Oct. 19, 2009 (KR) ..... 10-2009-0099388
Dec. 17, 2009 (KR) ..... 10-2009-0125933

(51) Int. Cl.
*A45D 34/04* (2006.01)

(52) U.S. Cl.
CPC ..... *A45D 34/04* (2013.01); *A45D 34/046* (2013.01); *A45D 2200/055* (2013.01)

(58) Field of Classification Search
CPC ..... G01F 11/02; G01F 11/04; G01F 11/06; G01F 11/021; G01F 11/028; A45D 34/04; A45D 34/046; A45D 2200/055; B01L 3/022; B01L 3/0224; B01L 3/0234; B01L 3/0217; B01L 3/0282; A61J 1/2051
USPC ..... 141/22, 23, 25, 27, 380, 381; 222/47, 222/49, 205, 309, 420–422, 108–111
See application file for complete search history.

(56) References Cited

U.S. PATENT DOCUMENTS 1,178,512 A * 4/1916 Garlock ..... 141/23
1,340,078 A * 5/1920 Peoples ..... 141/23

(Continued)

FOREIGN PATENT DOCUMENTS

CH 410 282 * 3/1966
JP 08-256830 A 10/1996

(Continued)

OTHER PUBLICATIONS

International Search Report for PCT/KR2009/007576 filed on Dec. 17, 2009.

*Primary Examiner* — Mark A Laurenzi
*Assistant Examiner* — Andrew Stclair

(57) ABSTRACT

The present invention relates to a liquid dropper allowing quantitative withdrawal and discharge, comprising a liquid-dropper tube formed with an annular projecting part around the outer circumferential rim at the upper end, a lid which is joined to the upper end of the liquid-dropper tube and is formed with a through hole in the center, a liquid-dropper piston which is formed with a press pin at the lower end and is inserted inside the liquid-dropper tube and which passes through the through hole, a button which is provided joined to the upper end of the liquid-dropper piston, and packing which is provided on the lower part of the annular discharge part of the liquid-dropper tube and is formed with a projecting part around a lower outer circumferential rim; and to a cosmetic container equipped with the same.

6 Claims, 8 Drawing Sheets

(56) References Cited

U.S. PATENT DOCUMENTS

| | | | | | |
|---|---|---|---|---|---|
| 1,453,444 | A | * | 5/1923 | Covell | 222/49 |
| 1,453,445 | A | * | 5/1923 | Covell | 222/49 |
| 2,129,144 | A | * | 9/1938 | Lancaster | 141/23 |
| 2,173,662 | A | * | 9/1939 | Plattring et al. | 222/420 |
| 2,845,963 | A | * | 8/1958 | Zackheim | 141/24 |
| 3,059,342 | A | * | 10/1962 | Beal | 33/308 |
| 3,094,245 | A | * | 6/1963 | Mizuno | 222/43 |
| 4,376,591 | A | * | 3/1983 | Proffer | 401/127 |
| 4,759,755 | A | * | 7/1988 | Hein et al. | 604/403 |
| 4,941,519 | A | * | 7/1990 | Sestak et al. | 141/22 |
| 5,113,711 | A | * | 5/1992 | Davloor | G01N 1/12 73/764.63 |
| 5,445,038 | A | * | 8/1995 | Hueller | G01N 1/12 73/864.44 |
| 5,746,349 | A | * | 5/1998 | Putteman et al. | 222/49 |
| 5,770,160 | A | * | 6/1998 | Smith | B01L 3/0217 422/525 |
| 5,836,359 | A | * | 11/1998 | Seidler | 141/23 |
| 6,045,003 | A | * | 4/2000 | Seidler | 222/48 |
| 6,112,779 | A | * | 9/2000 | Camilla | 141/23 |
| 6,250,504 | B1 | * | 6/2001 | Maffei | 222/49 |
| 6,273,152 | B1 | * | 8/2001 | Buehler et al. | 141/22 |
| 6,609,635 | B1 | * | 8/2003 | Maffei | 222/39 |
| 7,429,141 | B2 | * | 9/2008 | Habatjou | 401/127 |
| 7,434,602 | B2 | * | 10/2008 | Barone | 141/112 |
| 8,403,008 | B2 | * | 3/2013 | Bouix et al. | 141/27 |
| 2002/0158089 | A1 | * | 10/2002 | Mehta | 222/420 |

FOREIGN PATENT DOCUMENTS

| | | | |
|---|---|---|---|
| JP | 2004-65467 | A | 3/2004 |
| KR | 20-0338723 | Y1 | 1/2004 |
| KR | 20-0440620 | Y1 | 6/2008 |

* cited by examiner

LIQUID DROPPER ALLOWING QUANTITATIVE WITHDRAWAL, AND A COSMETIC CONTAINER EQUIPPED WITH THE SAME

TECHNICAL FIELD

The present invention relates to a liquid dropper allowing quantitative withdrawal and to a cosmetic container equipped with the same, and in particular to a liquid dropper controlling the quantity of its content and a cosmetic container therewith which liquid dropper comprises a liquid dropper tube 210 having an annular projecting part 211 along an upper end along an outer surface, a lid 220 engaged to an upper end of the liquid dropper tube 210 and having a through hole 221 at its center, a liquid dropper piston 230 having a press pin 231 at its lower end and being inserted in the interior of the liquid dropper tube 210 and passing through the through hole 221, a button 240 engaged at an upper end of the liquid dropper piston 230, and a packing 250 which is installed at a lower side of the annular projecting part 211 of the liquid dropper tube 210 and having a projecting part 251 along a lower outer surface.

BACKGROUND ART

As a method for using a liquid content such as cosmetics which should be quantitatively used like an eye cream which is used by a certain amount, the content is separately packaged by a certain amount in a form of a capsule containing as much as to be used for each use. The above mentioned individual packaging method is disadvantageous in that a relatively more amount of contents might remain in the capsule after a user used it, so the individual packing method is very inefficient.

In order to overcome the above individual packaging method, a discharge means made in a conventional liquid dropper or syringe structure might be used after content is filled in a container or a discharge means with the construction of a push pump might be used, so the content is discharged whenever it is needed to use.

In case of a discharge means of a conventional liquid dropper structure, the amount of content to be sucked and discharged changes depending on the level that a user pushes, so it is almost impossible to discharge an accurate amount of the content whenever it is used.

In addition, when a discharge means of a syringe type is used, it is generally designed for a small amount above or below 1 ml, so there are problems in that it is needed to make the diameter of a syringe very small or to make a stroke of a syringe piston very small. When it is needed to discharge certain content in such a way to suck content by pulling the piston of a syringe for the purpose of discharging content and then to push the piston of a syringe, the procedures of using are complicated.

In case of the discharge means with a construction of a push pump, it is possible to discharge a certain amount of the content whenever a button is pushed; however the structure of forming the inner and outer sides of the pump is formed of a button, a suction part, a discharge part, a spring and a valve structure, so the construction is relatively complicated. Due to the natures of the push button installed at top of the container, a suction tube is generally used for the purpose of sucking content; however in this case it is impossible to discharge the content even in a state that the content remains in the container depending on the position of a suction tube.

DISCLOSURE OF INVENTION

Accordingly, the present invention resolves the problems encountered in the conventional art. It is an object of the present invention to provide a liquid dropper allowing quantitative withdrawal and to a cosmetic container equipped with the same which are characterized in that it is possible to suck an accurate amount of liquid content such as cosmetic or something and use the sucked content in a simple and inexpensive structure without handling in a complicated way.

In addition, since the content stuck on an outer surface of the liquid dropper tube is collected into the container by means of a wiper during the procedure that a liquid dropper is taken out, so the content can be used more economically, and there is not a danger of contamination which might occur due to the content stuck on an outer surface of the liquid dropper tube.

To achieve the above objects, there is provided a liquid dropper 200 controlling the quantity of its content which comprises a liquid dropper tube 210 which has an annular projecting part 211 formed at its upper end along an outer surface; a lid 220 which is engaged to a upper end of the liquid dropper tube 210 and has a through hole 221 at its center; a liquid dropper piston 230 which has a press pin 231 at a lower end and is inserted into the interior of the liquid dropper tube 210 and passes through a through hole 221; a button 240 which is engaged to an upper end of the liquid dropper piston 230; and a packing 250 which is installed at a lower side of the annular projecting part 211 of the liquid dropper tube 210 and has a projecting part 251 formed along a lower outer surface.

In addition, an inner diameter of a lower end of the liquid dropper tube 210 decreases, and a shoulder 234 is formed at an upper side of the liquid dropper piston 230 and is caught by a lower end of the lid 220, and a pin head 232 is installed at a lower end of the press pin 231 and has a diameter corresponding to a decreased inner diameter of the lower end of the pin head 232.

Meanwhile, there is provided a cosmetic container having a liquid dropper 200 controlling the quantity of its content which comprises a container 110 which includes a function storing content and has a concave part 111 at a portion coming into contact with the press pin 231 at an inner lower side and has an engaging part 120 at its upper side; and an inner cap which is detachably engaged to the engaging part 120 and has a through hole 131 formed at a center for the liquid dropper 20 to detachably insert into the though hole 131 in such a way to be sealed by means of a packing 250.

In addition, there are further provided a wiper 150 which is inserted and installed at an outer surface of the engaging part 120 and is made of an elastic material in such a way that its inner diameter corresponding to an outer diameter of the liquid dropper tube 210 gradually decreases in its downward direction; and an over cap 140 which is installed at an upper side of the container 110 in such a way to detachably lid the liquid dropper 200.

Meanwhile, there is provided a liquid dropper 200' controlling the quantity of its content according to another embodiment of the present invention which comprises a liquid dropper tube 210' an upper side and a lower side of which are open for an engagement of the liquid dropper piston 230' and for content to be sucked, with a gasket 212 being engaged to the opened upper side; a lid 220' which is engaged to an upper side of the liquid dropper tube 210' and has a through hole 221 at its center and an engaging protrusion 222 at both sides of a lower outer surface; a liquid dropper piston 230' which has a plunger tip 235 at its lower end and is inserted into the interior of the liquid dropper tube 210' and passes though the through hole 221; and a button 240' which is engaged at an upper side of the liquid dropper piston 230'.

In addition, an inner diameter of a lower end of the liquid dropper tube 210' decreases, and a projecting part 213 engaged to the lid 220' is formed at an upper outer surface, and an engaging groove 223 corresponding to the projecting part 213 is formed at an inner surface of the lid 220'.

There is provided a cosmetic container having a liquid dropper 200' controlling the quantity of its content according to another embodiment of the present invention which comprises a container 110' which has a function storing content and has a concave part 111' at a portion coming into contact with the plunger tip 235 at an inner lower end and has an engaging part 120' at its upper side; and an inner cap 130' which is detachably formed at the engaging part 120' and has a through hole 131' formed at its center for the liquid dropper 200' to detachably insert and has a fixing piece 132 corresponding to the engaging protrusion 222 at an inner surface for an engagement as the engaging protrusion 222 rotates in one direction.

In addition, there are further provided a wiper 150' which is inserted into an inner surface of the engaging part 120' and is made from an elastic material in such a way that an inner diameter corresponding to an outer diameter of the liquid dropper tube 210' gradually decreased in its downward direction and has a plurality of spaced-apart support protrusions 151 at its inner surface for the purpose of supporting the liquid dropper tube 210' and has an air hole 152 at its lower side for air to flow.

ADVANTAGEOUS EFFECTS

According to the present invention, the liquid dropper allowing quantitative withdrawal and to a cosmetic container equipped with the same are featured in that it is possible to suck an accurate amount of liquid content such as cosmetic or something and use the sucked content in a simple and inexpensive structure without handling in a complicated way.

In addition, since the content stuck on an outer surface of the liquid dropper tube is collected into the container by means of a wiper during the procedure that a liquid dropper is taken out, so the content can be used more economically, and there is not a danger of contamination which might occur due to the content stuck on an outer surface of the liquid dropper tube.

BEST MODES FOR CARRYING OUT THE INVENTION

Figure 1:
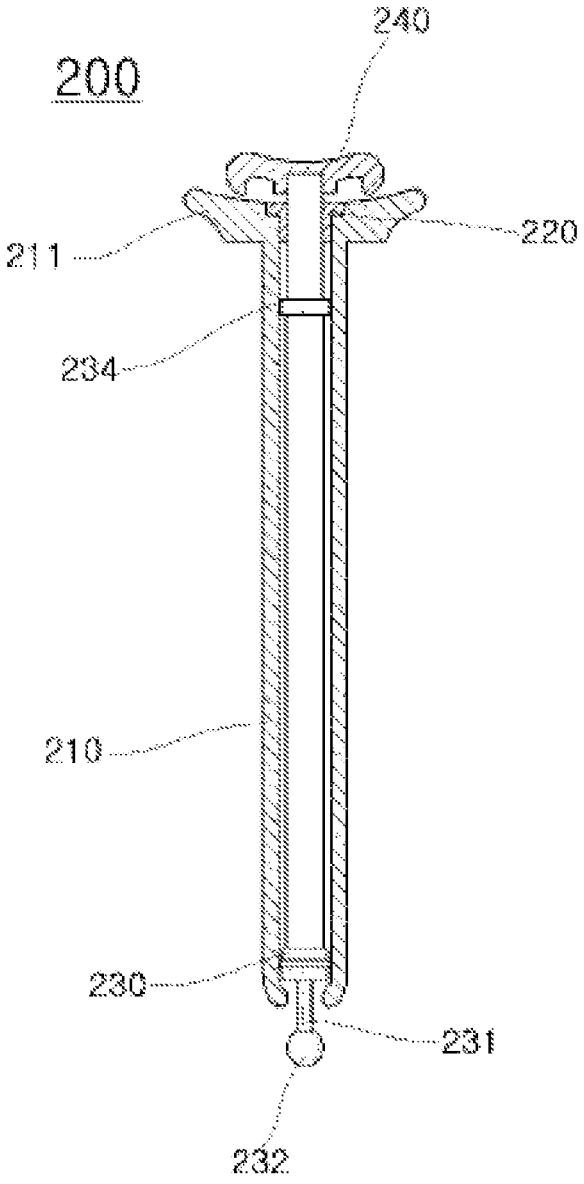
FIG. 1 is a cross sectional view illustrating a liquid dropper allowing quantitative withdrawal according to an embodiment of the present invention.

The liquid dropper allowing quantitative withdrawal and to a cosmetic container equipped with the same according an embodiment of the present invention will be described in details with reference to the accompanying drawings. In the drawings, the same elements or members represent the same reference numerals. The descriptions on the known art or construction will be omitted in an attempt not to make unclear the subject matters of the present invention.

The liquid dropper 200 facilitating a quantitative discharge will be described. As shown in FIG. 1, the liquid dropper 200 comprises a liquid dropper tube 210, a lid 200, a liquid dropper piston 230, a button 230 and a packing 250.

As shown in FIG. 1, the liquid dropper tube 210 is characterized in that an annular projecting part 211 is formed at an upper end portion. It is preferred that the lower end of the liquid dropper tube 210 has a diameter decreasing toward its lower direction for the purpose of ensuring that the content is prevented from leaking when the content stored therein is transferred to a certain place.

As shown in FIG. 1, a lid 220 having a through hole 221 at its center is engaged at an upper end of the liquid dropper tube 210.

Figure 2:
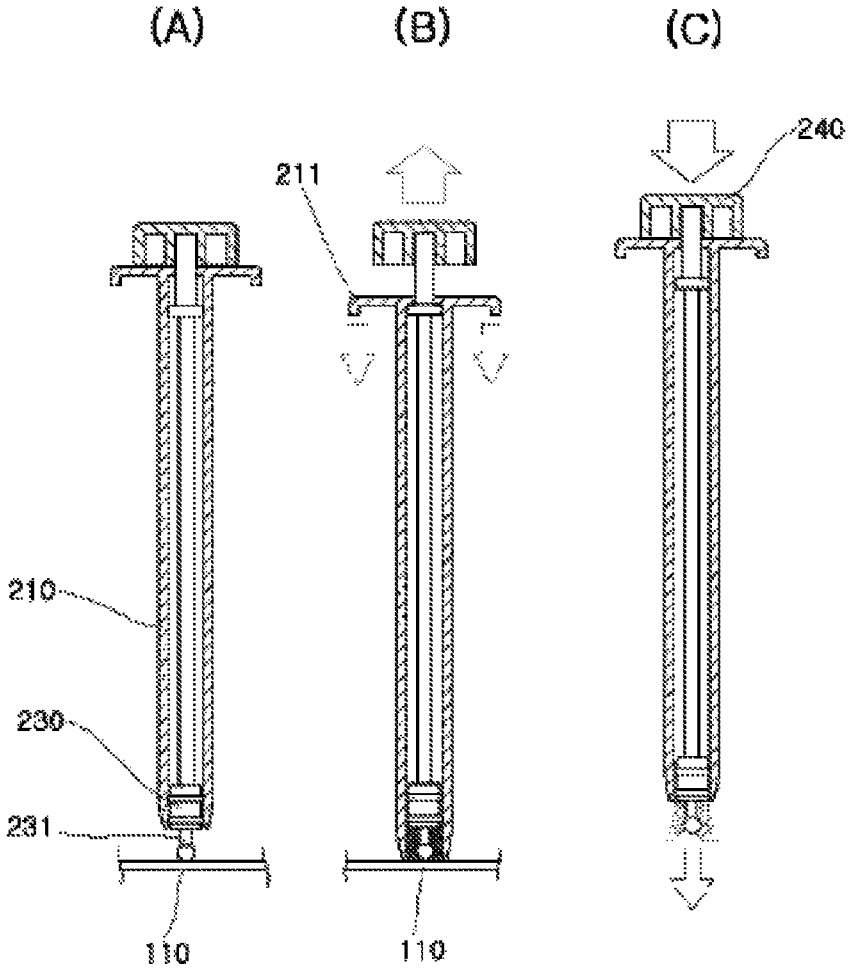
FIG. 2 is a perspective view illustrating an operation of a liquid dropper allowing quantitative withdrawal according to an embodiment of the present invention.

As shown in FIG. 1, in the interior of the liquid dropper tube 210 is disposed a press pin 231 at its lower end. A liquid dropper piston 230 is inserted into the interior of the liquid dropper tube 210 and passes through the through hole 221. In this case, as shown in FIG. 1, it is preferred that a shoulder 234 to be caught by means of the lower side of the lid 220 is formed at an upper side of the liquid dropper piston 230, so the liquid dropper piston 230 is prevented from escaping through the upper side of the liquid dropper tube 210. A pin head 232 is further installed at a lower end of the press pin 231 and has a diameter corresponding to the decreased inner diameter of the lower end of the liquid dropper tube 210. As shown in FIG. 2, it is preferred that the lower end of the liquid dropper tube 210 is partially blocked by the pin head 232 when content is sucked and transferred, thus preventing the leakage of content.

As shown in FIG. 1, a button 240 is engaged to an upper end of the liquid dropper piston 230. As show in FIG. 3, it is preferred that a packing 250 having a projecting part 251 formed along its outer surface is formed at a lower side of the annular projecting part 21 of the liquid dropper tube 210.

Figure 3:
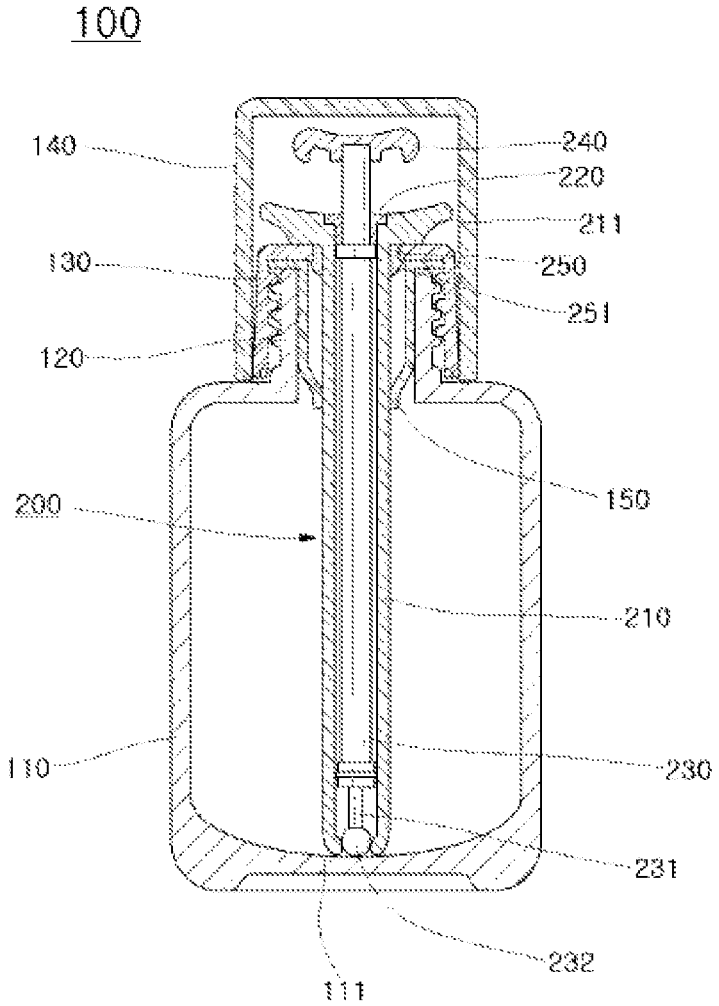
FIG. 3 is a cross sectional view illustrating a liquid dropper allowing quantitative withdrawal according to an embodiment of the present invention.
Figure 4:
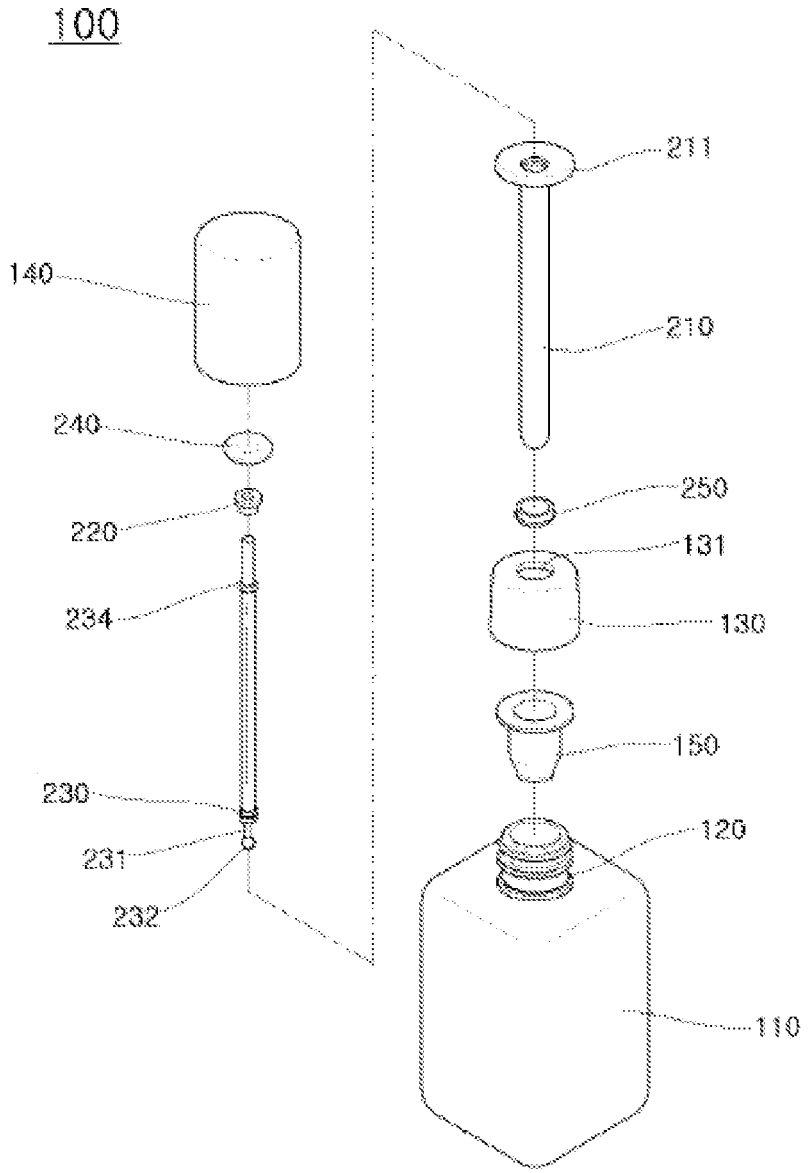
FIG. 4 is a disassembled perspective view illustrating a liquid dropper allowing quantitative withdrawal according to an embodiment of the present invention.

Next, the cosmetic container 100 with a liquid dropper 200 facilitating a quantitative discharge according to an embodiment of the present invention will be described. As shown in FIG. 3, the cosmetic container 100 comprises a liquid dropper 200, a container 110 and an inner cap 130.

As shown in FIG. 3, the container 110 serves to store content, and a concave part 111 is formed at an inner lower side, namely, at a portion where the press pin 231 comes into contact with, for the content to gather for a smooth suction when a little amount of content remains, and an engaging part 120 is formed at its top portion.

As shown in FIG. 3, an inner cap 130 having a through hole 131 formed at a central portion for the liquid dropper 200 to sealingly insert into the through hole 131 by means of the packing 250 is detachably engaged to the engaging part 120. The way that the inner cap 130 is detachably engaged to the engaging part 120 can be implemented in various ways. As one embodiment of the above operation, as shown in FIG. 3, threads are formed at an inner surface of the inner cap 130 and at an outer surface of the detachable engagement part 120 for screw engagements.

In order for the content stuck on the outer surface of the liquid dropper tube 210 to be collected into the container 110 during a procedure that the liquid dropper 200 is taken out, as shown in FIG. 3, it is preferred that an elastic wiper 150 is inserted and installed at an outer surface of the engaging part 120 with the inner diameter of the wiper being decreased toward the downward direction while corresponding to the outer diameter of the liquid dropper tube 210. In addition, it is preferred that an over cap 140 is further provided at an upper side of the container 100 for the purpose of detachably covering the liquid dropper 200.

The operation of the liquid dropper allowing quantitative withdrawal and to a cosmetic container equipped with the same according to an embodiment of the present invention will be described.

As show in FIG. 2A, the liquid dropper 200 is inserted in the container 110 with content. As shown in FIG. 2B, it is fully inserted by pressing the annular projecting part 211, so the press pin 231 of the lower end of the liquid dropper piston 230 is pushed, and the liquid dropper piston 230 rises, thus sucking a certain amount of content.

As shown in FIG. 2C, the liquid dropper 200 is removed and moved to a place for an actual use. A certain amount of content is discharged by pressing the button 240.

The liquid dropper allowing quantitative withdrawal and to a cosmetic container equipped with the same according to another embodiment of the present invention will be described with reference to FIGS. 5 through 9.

First, the liquid dropper 200' controlling its quantity according to another embodiment of the present invention comprises a liquid dropper tube 210', a lid 220', a liquid dropper piston 230', and a button 240'.

The liquid dropper tube 210' is formed with its upper and lower sides being open for the engagement with the liquid dropper piston 230' and for the content to be sucked, and it is preferred that a gasket 212 with a hollow part is engaged to an open upper side.

The inner diameter at the lower end of the liquid dropper tube 210' determines, and a projecting part 213 is formed at an outer surface of the upper side for an engagement with the lid 220'.

The lid 220' is engaged to an upper side of the liquid dropper tube 210, and a through hole 21 is formed at a central portion for the purpose of facilitating an engagement of the liquid dropper piston 230'. An engaging protrusion 222 to be engaged to the fixing piece 132 of the inner cap 130' is formed at both sides of a lower outer surface.

The engaging protrusion 222 is engaged to the fixing piece 132 when it rotates in one direction, thus fixing the lid 200' to the inner cap 130', and when it rotates in the other direction, the engaging protrusion 222 escapes from the fixing piece 132, thus moving the liquid dropper 200'.

It is preferred that an engaging groove 223 corresponding to the projecting part 213 for the purpose of facilitating an engagement of the liquid dropper tube 210' is formed at an inner surface of the lid 220'.

A plunger tip 235 is formed at a lower end of the liquid dropper piston 230' which is inserted into the liquid dropper tube 210' and passes through the through hole 221. In this case, a shoulder 234' is formed at an upper side of the liquid dropper piston 230', thus being caught by a lower end of the lid 220' for the purpose of ensuring that the liquid dropper piston 230' is prevented from escaping trough the upper side of the liquid dropper tube 210'.

The liquid dropper piston 230' serves to such content as it moves up and down in the interior of the liquid dropper tube 210', so a user can use a quantitative amount of the content.

Figure 5:
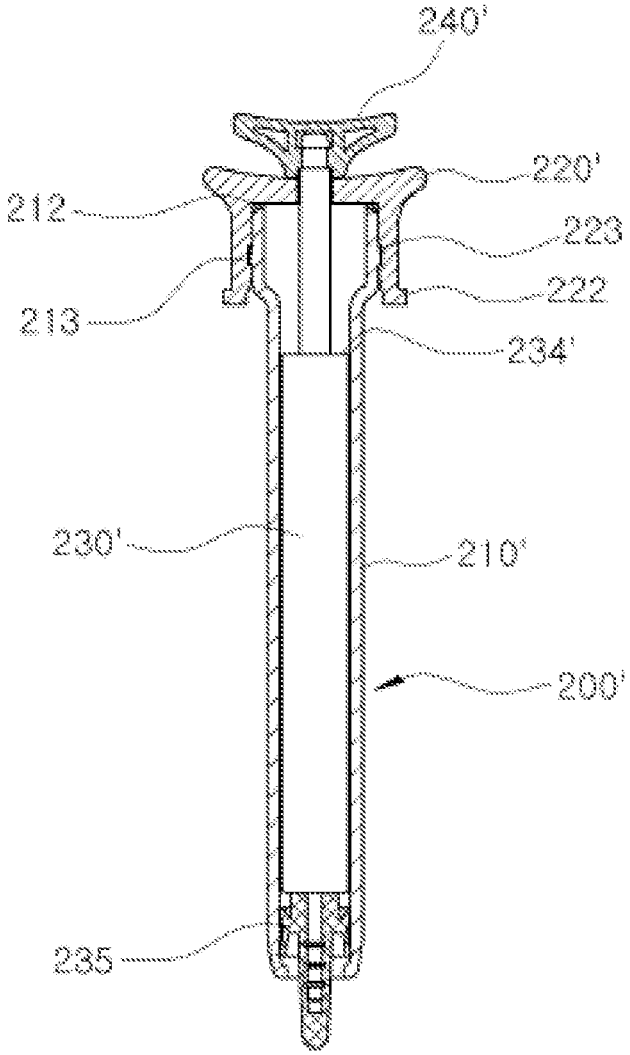
FIG. 5 is a cross sectional view illustrating a construction of a liquid dropper allowing quantitative withdrawal according to another embodiment of the present invention.
Figure 6:
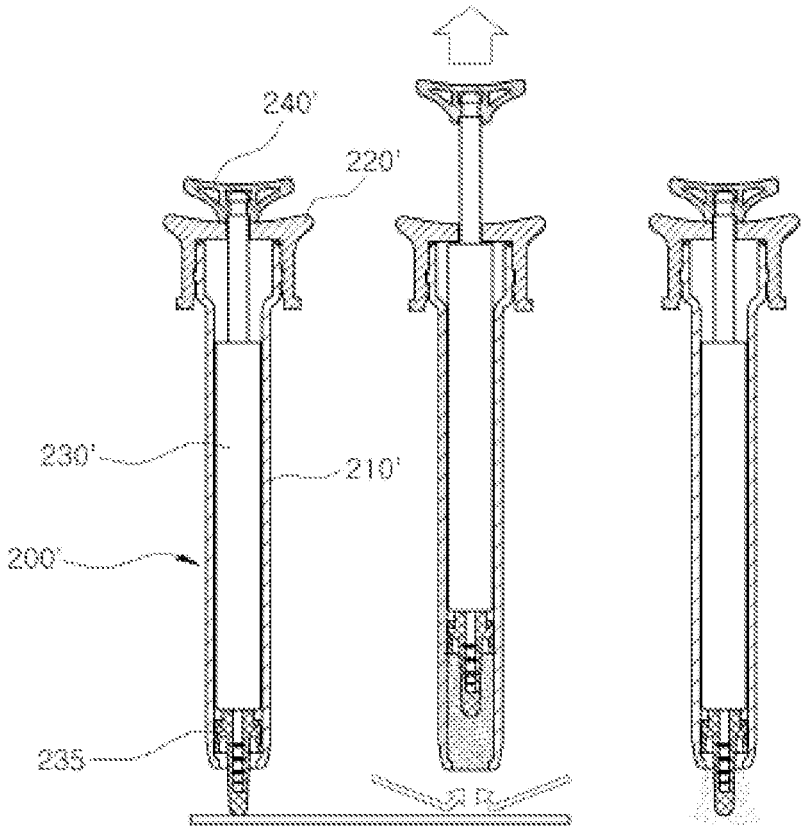
FIG. 6 is a perspective view illustrating an operation of a liquid dropper allowing quantitative withdrawal according to another embodiment of the present invention.
Figure 7:
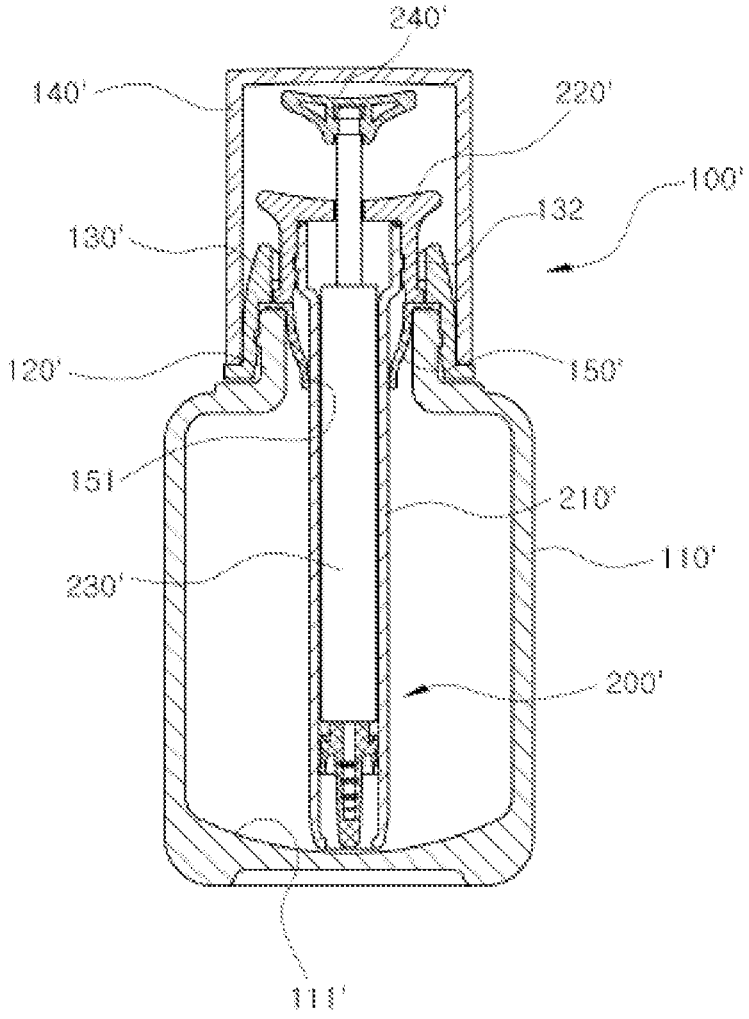
FIG. 7 is a cross sectional view illustrating a cosmetic container with a liquid dropper allowing quantitative withdrawal according to another embodiment of the present invention.
Figure 8:
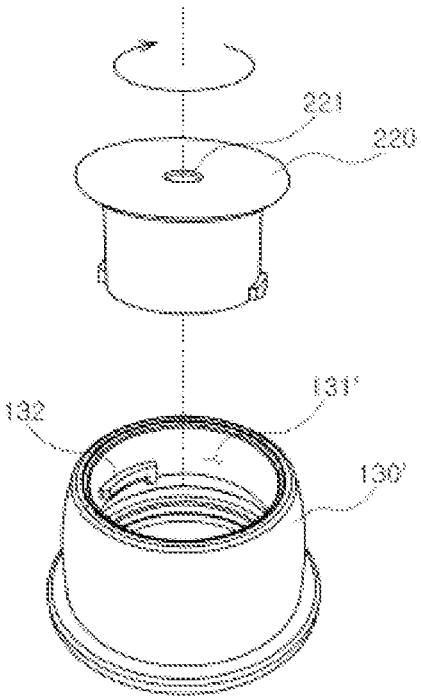
FIG. 8 is a view illustrating an engaged state of a lid and an inner cap of a cosmetic container with a liquid dropper allowing quantitative withdrawal according to another embodiment of the present invention.
Figure 9:
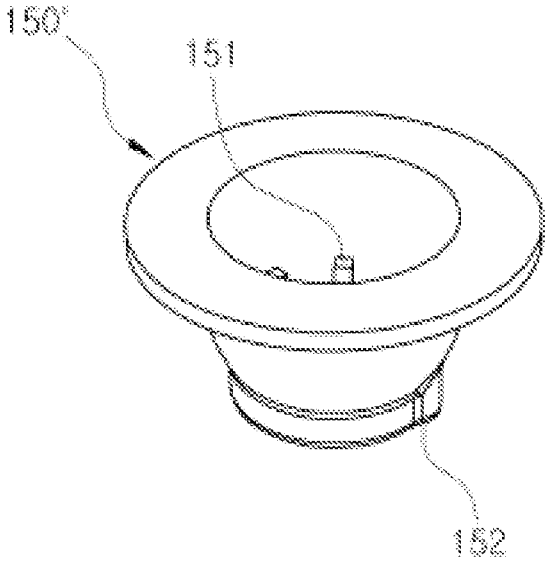
FIG. 9 is a perspective view illustrating a construction of a wiper of a cosmetic container with a liquid dropper allowing quantitative withdrawal according to another embodiment of the present invention.

As shown in FIG. 5, it is preferred that a button 240 is engaged at an upper end of the liquid dropper piston 230' for the purpose of facilitating an up and down movement of the liquid dropper piston 230' as a user operates.

Next, the liquid dropper controlling the quantity of its content and a cosmetic container therewith according to another embodiment of the present invention will be described.

The cosmetic container 100' with a liquid dropper facilitating a quantitative discharge according to another embodiment of the present invention comprises a container 110', an inner cap 130', and a liquid dropper 200'.

The container 110' serves to store the content, and a concave part 111' is formed at a portion coming into contact with the plunger top 235 at an inner lower end for the purpose of ensuring that content gathers and stays for a smooth suction when content remains a little, and an engaging part 120' is formed at an upper side.

An inner cap 130' is detachably engaged to the engaging part 120' with a through hole 131' being formed at a central portion of the inner cap 130' for the liquid dropper 200' to detachably insert into the through hole 131'. The present invention is characterized in that a fixing piece 132 corresponding to the engaging protrusion 222 is formed at an inner surface of the inner cap 130' for the purpose of ensuring that the engaging protrusion 222 of the lid 220' rotates in one direction and is engaged. When the lid 220' rotates in one direction, the liquid dropper 200' is fixed at the inner cap 130', and when the lid 220' rotates in the other direction, the liquid dropper 200' disengages from the inner cap 130'.

In order for the content stuck on the outer surface of the liquid dropper tube 210' to gather into the container 110' during a procedure that the liquid dropper 200's is taken out, it is preferred that at an inner surface of the engaging part 120' is provided an elastic wiper 150' the inner diameter of which corresponding to the outer diameter of the liquid dropper tube 210' gradually decreases in its downward direction.

A plurality of spaced-apart support protrusions 151 supporting the liquid dropper tube 210' are formed at an inner surface of the wiper 150', and an air hole 152 facilitating the flow of air is formed at a lower side.

In addition, it is preferred that an over cap 140' is engaged at an upper side of the container 110', thus detachably covering the liquid dropper 200'.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A liquid dropper apparatus allowing quantitative withdrawal, comprising:

a container storing content and having an opening at a top portion of the container; and a liquid dropper including:

a liquid dropper tube having an annular projecting part formed at an upper end of the liquid dropper tube;

a lid which is engaged to the upper end of the liquid dropper tube and has a first through hole at a center of the lid;

a liquid dropper piston which has a press pin at a lower end and passes through the first through hole;

a button which is engaged to an upper end of the liquid dropper piston; and a packing which is installed at a lower side of the annular projecting part of the liquid dropper tube and has a projecting part formed along a lower outer surface, wherein the press pin protrudes from a hole at a lower end of the liquid dropper tube when the button is pressed, and the press pin is entirely inserted into an interior of the liquid dropper tube when the press pin is pressed upward, wherein a pin head is disposed on a bottom surface of the press pin, the pin head having a diameter that corresponds to a diameter of the hole at the lower end of the liquid dropper tube, wherein a longitudinal length of the liquid dropper piston and a longitudinal length of the liquid dropper tube are such that the pin head is disposed in the hole at the lower end of the liquid dropper tube and contacts a bottom of the container when the liquid dropper is fully inserted into the container, and wherein a size of the press pin is smaller than that of the hole at the lower end of the liquid dropper tube such that the press pin passes through the hole with a clearance from an inner surface of the lower end of the liquid dropper tube when the liquid dropper tube is displaced upward relative to the liquid dropper piston.

2. The liquid dropper apparatus of claim 1, wherein an inner diameter of the lower end of the liquid dropper tube decreases, wherein a shoulder is formed at an upper portion of the liquid dropper piston and is blocked by a lower end of the lid, and wherein the pin head has a diameter corresponding to a decreased inner diameter of the lower end of the liquid dropper tube.

3. The liquid dropper apparatus of either claim 1 or claim 2, wherein the container includes an engaging part at an upper portion of the container and a concave part at an inner lower portion of the container, the concave part corresponding to a portion of the container that contacts the press pin when the liquid dropper is inserted into the container; and wherein the container further comprises an inner cap which is detachably engaged to the engaging part and has a second through hole formed at a center of the inner cap, the liquid dropper being detachably inserted into the second though hole and sealed by the packing.

4. The liquid dropper apparatus of claim 3, further comprising:

a wiper which is inserted and installed at an inner surface of the engaging part and is made of an elastic material in such a way that an inner diameter of the wiper gradually decreases in a downward direction; and an over cap which is installed at an upper side of the container to detachably lid the liquid dropper.

5. The liquid dropper apparatus container of claim 3, further comprising:

a wiper disposed on an inner surface of the engaging part of the container and including an upper flange portion, a bottom portion disposed under the upper flange portion, and an annular portion disposed between the upper flange portion and the bottom portion, wherein an inner diameter of the annular portion of the wiper is greater than an outer diameter of the liquid dropper tube, and wherein an inner diameter of the bottom portion decreases from an interface between the bottom portion and the annular portion of the wiper to a bottom surface of the bottom portion until the inner diameter of the bottom portion corresponds to the outer diameter of the liquid dropper tube.

6. The liquid dropper apparatus of claim 1, wherein the packing contacts the lower side of the annular projecting part, and the projecting part of the packing protrudes in a longitudinal direction of the liquid dropper tube.

* * * * *